US006742912B1

(12) United States Patent
Burys

(10) Patent No.: US 6,742,912 B1
(45) Date of Patent: Jun. 1, 2004

(54) LIGHT STRAIGHTENER

(76) Inventor: John L. Burys, 11404 S. Magnolia La., Alsip, IL (US) 60803

( * ) Notice: Subject to any disclaimer, the term of this patent is extended or adjusted under 35 U.S.C. 154(b) by 0 days.

(21) Appl. No.: 10/164,501

(22) Filed: Jun. 6, 2002

Related U.S. Application Data

(60) Provisional application No. 60/296,126, filed on Jun. 7, 2001.

(51) Int. Cl.[7] ..... F21V 21/00

(52) U.S. Cl. ..... 362/249; 362/231; 362/252; 52/633; 248/304

(58) Field of Search ..... 362/249, 231, 362/252, 227, 240; 248/304; 52/633

(56) References Cited

U.S. PATENT DOCUMENTS 6,050,701 A * 4/2000 Stone ..... 362/249
6,082,068 A * 7/2000 Fisher ..... 52/633
6,367,953 B1 * 4/2002 Lee ..... 362/252
6,394,752 B1 * 5/2002 Lai ..... 416/5
6,398,387 B1 * 6/2002 Wienhold ..... 362/231
6,527,413 B1 * 3/2003 McIngvale ..... 362/249
6,536,730 B1 * 3/2003 Baer ..... 248/304

* cited by examiner

*Primary Examiner*—Stephen Husar
*Assistant Examiner*—James W Cranson

(57) ABSTRACT

A light straightener for supporting a wire strand of lights separate from adjacent strands to prevent the strands from bunching up. The strands are retained in the straightener so they will not fall out regardless of the orientation of the straightener.

6 Claims, 2 Drawing Sheets

LIGHT STRAIGHTENER

This application is based on Provisional Application filed on Jun. 7, 2001 having S. No. 60/296,126.

BACKGROUND OF THE INVENTION

This device allows the individual strands of lights in for example an icicle light set to hang perfectly straight and elegantly instead of bunching up (zigzagging) due to the aberrant shape of the wires connecting the individual lights.

Icicle lights are decorative holiday lights that incorporate individual strands of wire with lights that hang down from one main wire. These individual strands typically comprise a set in a repetitive series. The set is usually three or four strands of varying lengths, generally from approximately 16" to 28" and usually in 4" or 8" increments, and containing anywhere between four (4) and seven (7) lights per strand respectively.

In every case, due to the inherent properties of this shielded wire and due to the method of packaging, the individual strands of wire (icicles) never hang straight, but typically in very angular patterns that cause each strand to blend into one another.

This is not only less attractive because the distinction of the individual icicles can no longer be ascertained, but the length of the individual strands are shortened, thereby reducing the entire effect. In addition, discounting the light bulbs, the zigzagging of the wires themselves is very unattractive and looks very sloppy, particularly in the daylight.

The invention will be clearly understood from the drawings and description thereof wherein.

Figure 1:
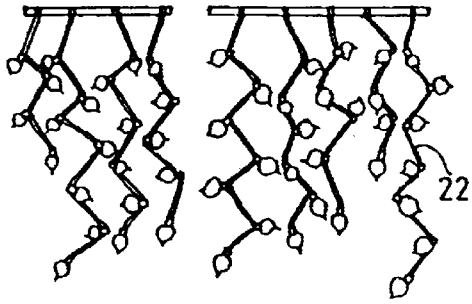
FIG. 1 shows an unattractive random array strips of lights.
Figure 2:
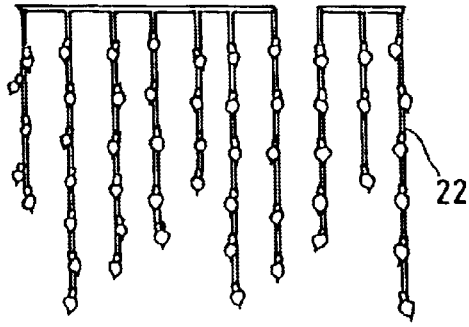
FIG. 2 shows a strip of lights employing my invention.
Figure 3:
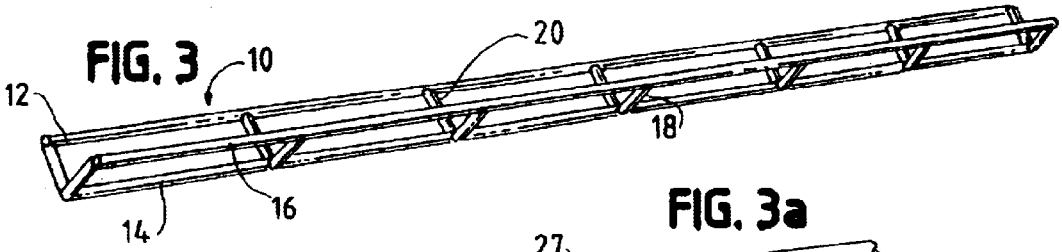
FIG. 3 illustrates a light straightener.
Figure 3A:
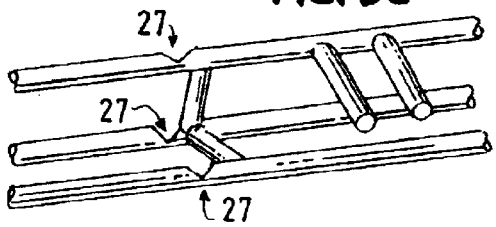

FIG. 3*a* is a section of a light straightener illustrating how one can me made of various lengths.

Figure 4:
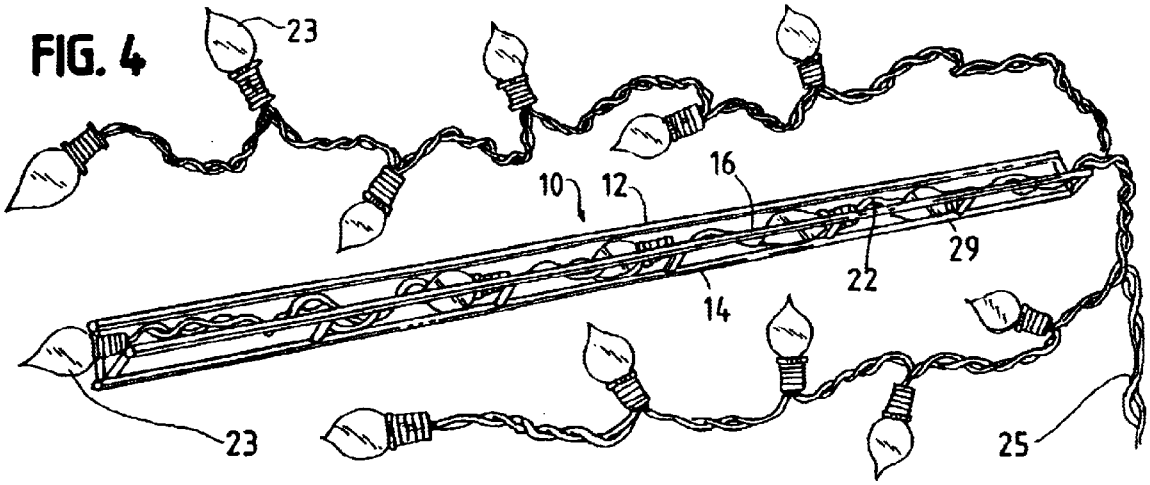
Figure 5:
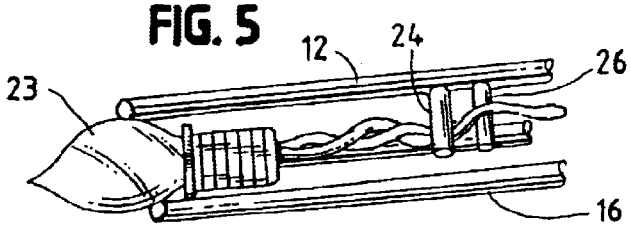
Figure 6:
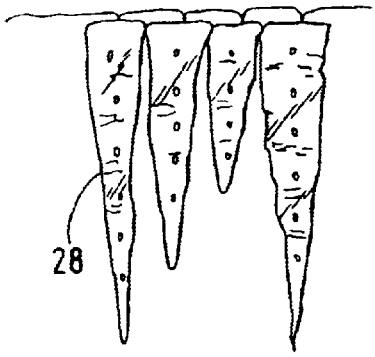
Figure 7:
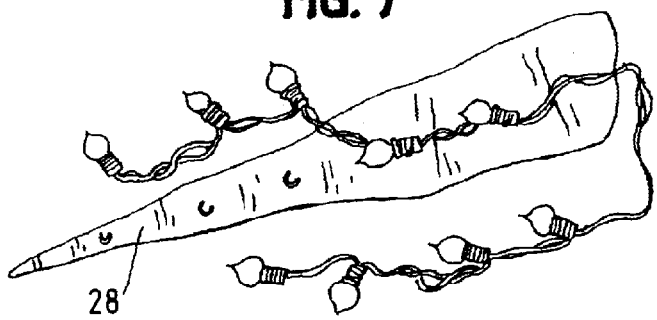
Figure 8:
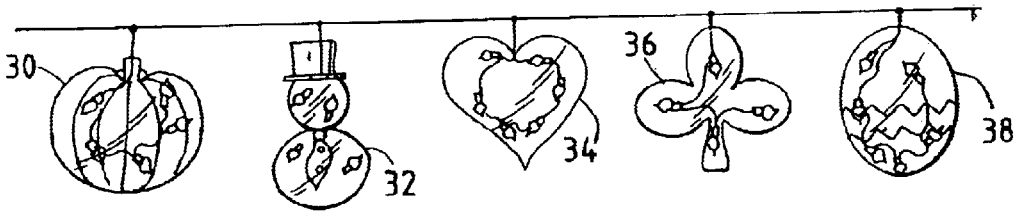
Figure 9:
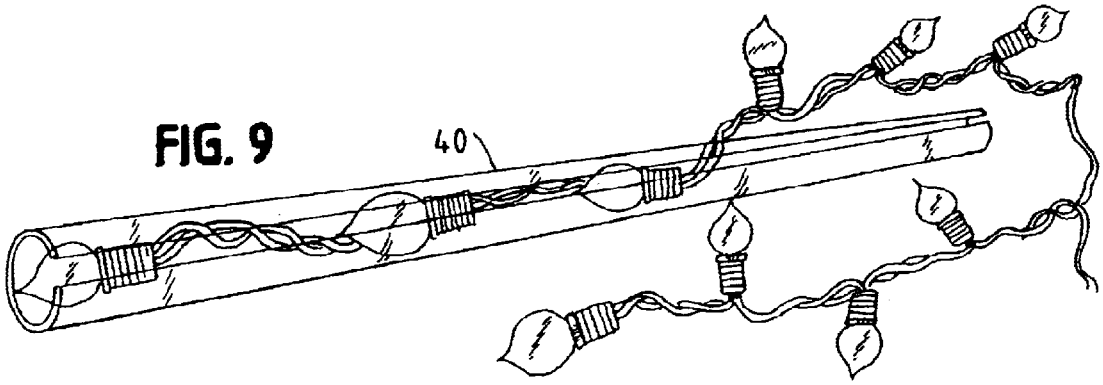

FIG. 4 shows a string of lights in a straightener;

FIG. 5 illustrates an end of a string of lights in the light straightener;

FIG. 6 shows the light straightener in the form of an icicle;

FIG. 7 illustrates the retaining means for the light strand in the straightener of FIG. 6;

FIG. 8 illustrates light straighteners in the form of different patterns or symbols;

FIG. 9 illustrates a generally tubular shaped straightener; and

Figure 10:
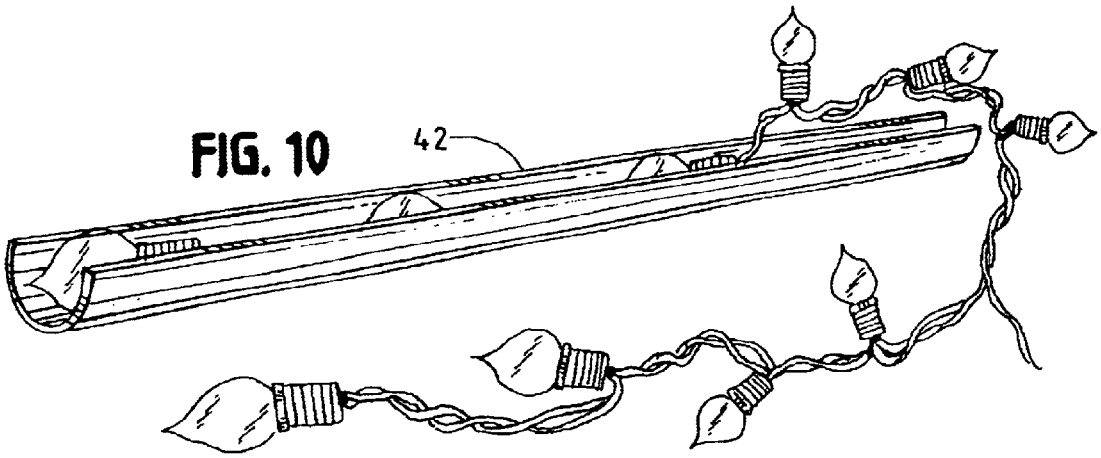

FIG. 10 illustrates a U-shaped straightener.

My novel Light Straightener solves the problem of the lights bunching up by utilizing a channel 10 (See FIG. 3) formed from three rods 12, 14, 16 (ideally translucent or white plastic) of the same length and diameter (approximately ⅛"). Two rods are connected to one main rod via two short connecting rods 18, 20 placed approximately at 4" intervals. These connecting rods are approximately ⅜" in length and form an equilateral triangle down the length of the three rods thereby forming the channel 10. The channel formed by these lengths of rod is open and within this channel is placed an individual icicle strand 22.

From the top of the strand of lights which is an offshoot of the main wire 25, the wire 29 and each light bulb 23 is placed within the open channel. The light bulbs 23 easily snap in and out because they pressure fit into the very center of the three rods. The light bulbs are held very securely so that they will not be able to slide easily within the channel and the Icicle Light Straightener will not be able to slide off even when it hangs vertically.

Additionally, down the length of the rods at approximately 4" intervals, are two short rods or prongs 24, 26 that do not completely connect to the rod opposite it. This is so the wire can be stranded in and out through these prongs to achieve additional security from slippage. A channel of three rods has been chosen because it provides the maximum exposure of the light bulbs through each of its three sides thereby providing a more brilliant lighting effect that will be visible no matter what the angle is of the channel.

Translucent plastic or white plastic is preferable not only because of the economic and manufacturing factors, but because light will travel through the translucent plastic slightly intensifying the dispersion of light and the white plastic will reflect the light also intensifying the effect. Additionally, these are less obtrusive, universal colors that will remain attractive during daylight hours, and white is usually the color of the wires incorporated into icicle lights.

Since typically there are three or four different lengths of strands of icicles varying on average from 16" to 28" in increments of 4" or 8", the Icicle Light Straighteners come in 28" lengths with perforations 27 (See FIG. 3*a*) at 4" intervals so that the extra material not needed for a short icicle of 16" can be simply snapped off. This extra 12" of material can then be used, if so desired by the consumer, in conjunction with another piece that had been snapped off to accommodate say a 24" icicle. Now the consumer has an extra Icicle Light Straightener that can accommodate one more 16" icicle. These perforations not only allow for customization of the individual icicles and eliminate waste, but allow the Icicle Light Straightener to be more universal and fit a variety of different size icicle lights made by different manufacturers.

An additional positive factor of the Icicle Light Straightener is the factor of storing convenience. The consumer will not have to worry or contend anymore with tangled wires that sometimes take hours to unravel if they simply leave the individual strands within the Icicle Light Straightener.

Although what has been described above is the most efficient and practical design of the Icicle Light Straightener and serves a purpose that will be universally desired by consumers, there are other options which would cater more to specific purposes and tastes.

For example, the design of the Icicle Light Straightener could actually be formed out of clear or translucent molded plastic that resembles an actual icicle. 28 (See FIGS. 6 and 7) The wires and light bulbs would snap on behind or within the icicle to illuminate it from within.

Additionally, the Icicle Light Straightener need not straighten the strands of lights simply vertically but could form the individual strands of lights into different patterns or symbols as shown in FIG. 8. This would be perfect for celebrating different holidays. For example, round, orange, plastic pumpkins 30 or skull and monster heads can be designed for Halloween. The pumpkins would also be appropriate for Thanksgiving. Additionally, Santa heads, snowmen 32, etc. can be designed for Christmas. Hearts and cupids 34 could be designed for Valentine's Day. Green shamrocks 36 could be designed for St. Patrick's Day and Easter eggs 38 and bunny rabbits could be designed for Easter.

There are several very attractive features of this concept Firstly, there is the obvious upsell marketing strategy, taking an existing product that many people already have purchased an attaching several different desirable products that work in conjunction with the already purchased product.

Additionally, consumers will find it appealing, especially those who experience a real winter, to install their holiday lights for Christmas in October when the weather is still often temperate. They simply would install their icicle lights as they normally would for Christmas, but instead attach the plastic pumpkins to the individual strands instead of the Icicle Light Straighteners. Then, come November, all they would need to do is remove the pumpkins and attach the Icicle Light Straighteners which is very simple. The same thing would apply toward the end of the season, substituting the Icicle Light Straighteners for Valentine's Day hearts, shamrocks, Easter eggs, and then finally removing them altogether when the weather is again more temperate.

The Icicle Light Straighteners can also be designed in several other styles utilizing extruded plastics.

One such example is the utilization of a clear flexible or-semi-rigid plastic tube 40 (See FIG. 9) that is 28" in length with an approximate inside diameter of ⅜". (This tube can also be conically shaped to more closely resemble an icicle.) The tube is slit down the length allowing it to be opened up just enough slip a strand of icicle lights within the tube. Due to the characteristics of the plastic and its pre-formed tubular shape, the tube will close upon itself and upon the strand of icicle lights assuring a snug fit to prevent slippage as it hangs vertically.

Additional security from slippage is provided by a fastener designed to attach to the plastic tube and then encompass the main wire from which each icicle light strand hangs as displayed below.

Another alternative shown in FIG. 10 is an extruded clear rigid plastic that is formed into a U-shaped channel 42 that is 28" long and whose interior dimensions are approximately ⅜". In this case, each of the individual light bulbs on the icicle light strand snaps securely in the U-shaped channel down its length.

The positive attributes of each of the aforementioned cases are many. From a manufacturing standpoint, extruded plastic is very easy to manufacture and to cut off at the appropriate lengths. Due to the minimal wall thickness of the tube and U-shaped channel, the consumer can easily take a pair of scissors or other cutters and simply snip off any excess length. The same applies to the excess as before where the excess is trimmed off of several different 28" lengths can be added together to form a longer length to cover an additional icicle light strand thereby eliminating waste.

Additionally, this type of extruded plastic can be manufactured in a variety of transparent or translucent colors which may appeal to consumers. For example, the Icicle Light Straightener may be manufactured in transparent red and green so that the consumer can alternate the colors on their icicle lights in effect customizing their icicle lights. Or the Icicle Light Straighteners may be manufactured in a cool transparent blue or a translucent white to create other effects.

The Icicle Light Straighteners utility and marketability is abundantly clear. It serves both a utilitarian and aesthetic purpose. With the explosive popularity of icicle lights, it is clear to see that the Icicle Light Straighteners will find a home on everyone's home, for this and all future holiday seasons.

It is intended to cover by the following claims all embodiments that fall within the true spirit and scope of the invention.

What is claimed is:

1. A light straightener for supporting a wire strand of lights in an orientation separate from an adjacent strand of lights whereby a light strand will not bunch up with an adjacent strand and make for an unsightly display that generally consists of three rods disposed in a V-shape supported along its length to receive a strand of lights in a straight line, two of the rods define a space therebetween to receive the lights in a snug fashion with the third rod serving as a support for the lights whereby the strand when disposed within the V-shaped rods will not fall out if the light straightener is held in a horizontal or vertical position.

2. A light straightener as set forth in claim 1 in which the rods are supported in the V-configuration along their length by short connecting rods spaced at 4" intervals.

3. A light straightener as set forth in claim 1 in which the rods form an equilateral triangle.

4. A light straightener as set forth in claim 2 in which the rods are made of a plastic translucent material.

5. A light straightener as set forth in claim 3 in which at one end thereof there is provided two short rods that do not completely connect to the rod opposite it so the wire strand can be disposed in and out through said short rods to achieve additional security from slippage.

6. A light straightener as set forth in claim 2 in which notches are provided in said rods along the length thereof so the light straightener can be made of various lengths.

* * * * *